US007297457B2

(12) United States Patent
Horgan et al.

(10) Patent No.: US 7,297,457 B2
(45) Date of Patent: Nov. 20, 2007

(54) PHOTOSENSITIVE MEMBER HAVING AN ELASTOMERIC TRANSPORT LAYER WITH A PROTECTIVE OVERCOAT LAYER

(75) Inventors: Anthony M. Horgan, Pittsford, NY (US); Robert C. U. Yu, Webster, NY (US); Satchidanand Mishra, Webster, NY (US); Richard L. Post, Penfield, NY (US); Edward F. Grabowski, Webster, NY (US); Min-Hong Fu, Webster, NY (US); Kathleen M. Carmichael, Williamson, NY (US); David M. Skinner, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 432 days.

(21) Appl. No.: 10/993,286

(22) Filed: Nov. 18, 2004

(65) Prior Publication Data

US 2006/0105252 A1 May 18, 2006

(51) Int. Cl.
*G03G 15/02* (2006.01)

(52) U.S. Cl. ..... 430/58.8; 430/59.6; 430/66; 399/159

(58) Field of Classification Search ..... 430/58.8, 430/59.6, 66; 399/159
See application file for complete search history.

(56) References Cited

U.S. PATENT DOCUMENTS 6,025,102 A * 2/2000 Pai et al. ..... 430/58.8

* cited by examiner

*Primary Examiner*—Mark A. Chapman
(74) *Attorney, Agent, or Firm*—Annette L. Bade

(57) ABSTRACT

An imaging member having a substrate, a charge transport layer having a polymer and a first charge transport material dispersed therein, and wherein the charge transport layer has a glass transition temperature of from about 10 to about 45° C.; and an overcoat layer on the charge transport layer, wherein the overcoat layer includes a second polymer and a second charge transport material dispersed therein.

16 Claims, 1 Drawing Sheet

PHOTOSENSITIVE MEMBER HAVING AN ELASTOMERIC TRANSPORT LAYER WITH A PROTECTIVE OVERCOAT LAYER

BACKGROUND

The photosensitive members described herein can be used as photosensitive members, photoreceptors or photoconductors useful in electrostatographic, including printers, copiers, other reproductive devices, and digital apparatuses. In specific embodiments, the photosensitive member comprises an elastomeric charge transport layer, having a specific glass transition temperature, and a protective overcoat layer.

Electrophotographic imaging members, including photoreceptors or photoconductors, typically include a photoconductive layer formed on an electrically conductive substrate or formed on layers between the substrate and photoconductive layer. The photoconductive layer is an insulator in the dark, so that during machine imaging processes, electric charges are retained on its surface. Upon exposure to light, the charge is dissipated, and an image can be formed thereon, developed using a developer material, transferred to a copy substrate, and fused thereto to form a copy or print. Electrophotographic imaging members are typically in rigid drum configuration and flexible belt form. Flexible imaging member belts may either be seamed or seamless belts. However, for reasons of simplicity, the disclosures hereinafter will focus only on electrophotographic imaging members in flexible belt form.

In typical negatively-charged electrophotographic imaging members, the top outermost exposed photoconductive layer is a charge transport layer. Therefore, the charge transport layer not only is repeatedly subjected to various machine subsystems mechanical interactions, it is also constantly exposed to corona effluents (emitted from charging device), and other volatile chemical (VOC) species/contaminants. Mechanical interactions against imaging member have caused charge transport layer wear, while corona effluent and chemical contaminants exposure gives rise to charge transport layer material degradation and lateral charge migration (LCM) problems. Charge transport layer material degradation and wear promote premature onset of mechanical failure and LCM impacts copy image quality print out.

Many advanced imaging systems are based on the use of a flexible imaging member belt mounted over and around a belt support module design using small diameter belt rollers to provide ease of paper stripping. The use of small diameters in belt module support rollers for the benefit of easy paper copy stripping is seen to be negated by the large charge transport layer bending strain induced during dynamic fatigue belt bending and/or flexing over each belt module support roller under normal machine functioning conditions. Imaging member bending strain leads to the development of charge transport layer cracking, which then manifests into copy print-out defects and limits the imaging member belt useful life. Moreover, exhibition of imaging member belt charge transport layer cracking has frequently been found to occur at those belt segments parked over the support rollers during prolong machine idling or overnight and weekend shut off periods brought on as a result of exposure to residual corona effluents and airborne chemical contaminants. The early onset of charge transport layer cracking is a serious belt material failure issue that impacts copy print out quality. This results in cutting short the functional performance of the imaging member belt prior to reaching its intended service belt life goal.

For typical negatively-charged imaging member belts, such as flexible photoreceptor belt designs, there are multiple layers comprised of a supporting substrate, a conductive ground plane, a charge blocking layer, an optional adhesive layer, a charge generating layer, and a outermost exposed charge transport layer. Flexible photoreceptor belts may also require an anti-curl back coating applied to the back side of the support substrate to render belt flatness.

Therefore, it is desired to provide an improved photoreceptor belt having a mechanically robust function, wherein the charge transport layer is less susceptible to cracking induced by fatigue bending, and is less susceptible to material failures due to exposure to contaminants from airborne chemical species and corona effluents.

SUMMARY

Embodiments include an imaging member comprising a substrate, a charge transport layer comprising a polymer and a first charge transport material dispersed therein, and wherein the charge transport layer has a glass transition temperature of from about 10 to about 45° C.; and an overcoat layer positioned on the charge transport layer, wherein the overcoat layer comprises a second polymer and a second charge transport material dispersed therein.

Embodiments also include an imaging member comprising an imaging member comprising a substrate; a charge transport layer comprising polystyrene and N,N'-diphenyl-N,N'-bis(3-methylphenyl)-[1,1'-biphenyl]-4,4' diamine dispersed therein, and wherein the charge transport layer has a glass transition temperature of from about 10 to about 45° C.; and an overcoat layer positioned on the charge transport layer, wherein the overcoat layer comprises a polymer selected from the group consisting of polycarbonate and polystyrene, and comprises N,N'-diphenyl-N,N'-bis(3-methylphenyl)-[1,1'-biphenyl]-4,4'diamine, and further wherein the overcoat layer has a thickness of from about 1 to about 10 microns.

In addition, embodiments include an imaging member comprising a substrate; a charge transport layer comprising polycarbonate, N,N'-diphenyl-N,N'-bis(3-methylphenyl)-[1,1'-biphenyl]-4,4'diamine, and a glass transition suppressing compound, and wherein the charge transport layer has a glass transition temperature of from about 10 to about 45° C.; and an overcoat layer positioned on the charge transport layer, wherein the overcoat layer comprises a polymer selected from the group consisting of polycarbonate and polystyrene, and comprises N,N'-diphenyl-N,N'-bis(3-methylphenyl)-[1,1'-biphenyl]-4,4'diamine, and further wherein the overcoat layer has a thickness of from about 1 to about 10 microns.

Moreover, embodiments include an image forming apparatus for forming images on a recording medium comprising a) a photoreceptor member having a charge retentive surface to receive an electrostatic latent image thereon, wherein the photoreceptor member comprises a substrate, a charge transport layer comprising a polymer and a first charge transport material dispersed therein, and wherein the charge transport layer has a glass transition temperature of from about 10 to about 45° C.; and an overcoat layer positioned on the charge transport layer, wherein the overcoat layer comprises a second polymer and a second charge transport material dispersed therein; b) a development component to apply a developer material to the charge-retentive surface to develop the electrostatic latent image to form a developed image on the charge-retentive surface; c) a transfer component for transferring the developed image from the charge-retentive surface to another member or a copy substrate; and d) a fusing member to fuse the developed image to the copy substrate.

BRIEF DESCRIPTION OF THE DRAWINGS

For a better understanding, reference may be had to the accompanying figures.

DETAILED DESCRIPTION

The improved photoreceptors described herein comprise an elastomeric charge transport layer with a protective overcoat. The elastomeric charge transport layer disclosed herein is less susceptible to development of premature onset of cracking induced by corona effluents and/or volatile organic chemical contaminants (VOC) exposure. In addition, the elastomeric charge transport layer is more mechanically robust to provide dynamic fatigue flexing and/or bending. This, in turn, allows for reduction or elimination of charge transport layer cracking. The charge transport layer herein is more elastic and has a specific glass transition temperature, to function as an elastomer layer and give elasticity under normal machine image processing conditions. Because of the increased elasticity of the charge transport layer, the layer has a reduced tendency to curl. In addition, the charge transport layer has a lower transition temperature, which causes the material to be soft. As a consequence, it is harder to remove toner with a conventional blade due to the softness of this layer. The overcoat solves these problems, as the overcoat is protective, and in embodiments, is relatively thin and hard. The elastomeric charge transport layer is more susceptible to surface wear by machine interacting subsystems. The overcoat, therefore, offers an effective solution and solves many problems, as the overcoat is protective.

In embodiments, the photoreceptor having the elastomeric charge transport layer, and a protective overcoat, results in a photoreceptor that is less susceptible to cracking, and less susceptible to attack by corona effluents or VOC contaminants.

Figure 1:
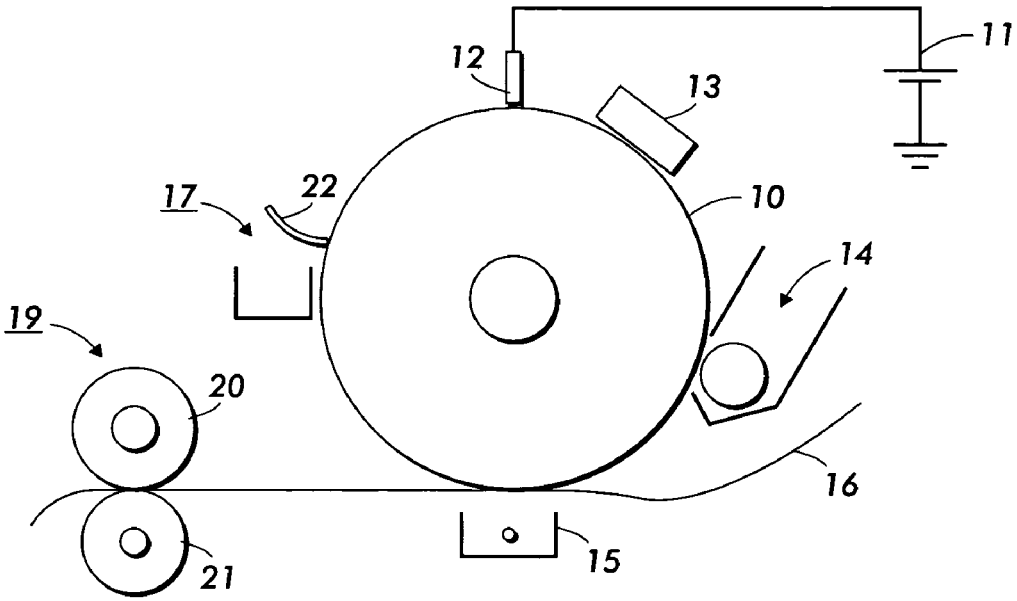
FIG. 1 is an illustration of a general electrostatographic apparatus using a photoreceptor member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles, which are commonly referred to as toner. Specifically, photoreceptor 10 (consisting of a flexible member belt mounted over an encircling a rigid drum) is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface of photoreceptor 10, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

However, in most cases, photoreceptor 10, used in the electrophotographic imaging apparatus shown in FIG. 1, is a flexible belt mounted over and around a belt support module using numbers of supporting rollers of varying diameters. The photoreceptor belt is constantly subjected to repeated bending strains as the belt flexes over each of the support rollers during dynamic fatigue machine belt imaging process. Fatigue photoreceptor belt bending/flexing is found to cause the charge transport layer cracking problem.

Figure 2:
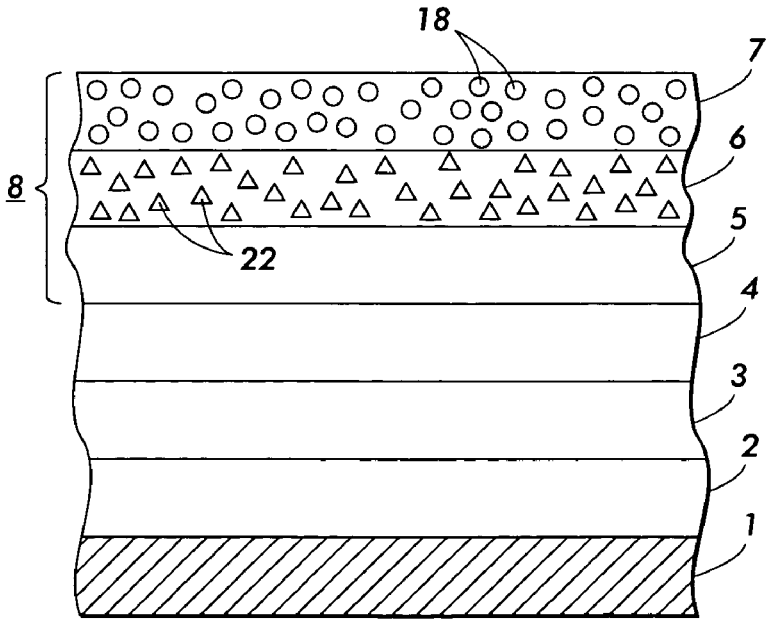
FIG. 2 is an illustration of an embodiment of an improved photoreceptor showing various layers.

Electrophotographic imaging members or photoreceptors are well known in the art. Electrophotographic imaging members may be prepared by any suitable technique. Referring to FIG. 2, typically, a flexible (for flexible belt configuration) or rigid (for rigid drum design) substrate 1 is provided with an electrically conductive surface or coating 2.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. On the other hand, the substrate 1 of a flexible imaging member belt may have less thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, or from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

For a negatively charged imaging member, an optional hole blocking layer 3 may be applied to the substrate 1. Any suitable and conventional blocking layer capable of forming an effective barrier to holes between the adjacent photoconductive layer 8 (or electrophotographic imaging layer 8) and the underlying conductive surface 2 of substrate 1 may be used.

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer 8 is formed on the adhesive layer 4, blocking layer 3 or substrate 1. The electrophotographic imaging layer 8 may be a single layer (5 in FIG. 2) that performs both charge-generating and charge transport functions as is well known in the art, or it may comprise multiple layers such as a charge generator layer 5 and charge transport layer 6 in the event that the imaging member is a negatively-charged photoreceptor.

The charge generating layer 5 can be applied to the electrically conductive surface, or on other surfaces in between the substrate 1 and charge generating layer 5. A charge blocking layer or hole-blocking layer 3 may optionally be applied to the electrically conductive surface prior to the application of a charge generating layer 5. If desired, an adhesive layer 4 may be used between the charge blocking or hole-blocking layer 3 and the charge generating layer 5. Usually, the charge generation layer 5 is applied onto the blocking layer 3 and a charge transport layer 6, is formed on the charge generation layer 5. This structure may alternatively have the charge generation layer 5 on top of or below the charge transport layer 6 to form a positively-charged photoreceptor.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer 6 may comprise a charge transporting small molecule 22 (or first charge transport compound) dissolved or molecularly dispersed in a film forming electrically inert polymer. The term "dissolved" as employed herein is defined herein as forming a solid solution in which the small molecule is dissolved in the polymer matrix to form a homogeneous phase. The expression "molecularly dispersed" as used herein is defined as a charge transporting small molecule dispersed in the polymer, the small molecules being dispersed in the polymer matrix on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up in machines with high throughput, the charge transport layer should be substantially free (less than about two percent) of di or triamino-triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

In embodiments, the charge transport layer comprises small hole transporting molecules such as triphenylmethane, bis(4-diethylamine-2-methylphenyl) phenylmethane, stylbene, hydrozone, an aromatic amine comprising tritolylamine, arylamine enamine phenanthrene diamine, N,N'-bis (4-methylphenyl)-N,N'-bis[4-(1-butyl)-phenyl]-[p-terphenyl]-4,4"-diamine, N,N'-bis(3-methylphenyl)-N,N'-bis[4-(1-butyl)-phenyl]-[p-terphenyl]-4,4"-diamine, N,N'-bis (4-t-butylphenyl)-N,N'-bis[4-(1-butyl)-phenyl]-[p-terphenyl]-4,4"-diamine, N,N',N",N'"-tetra[4-(1-butyl)-phenyl]-p-terphenyl]-4,4"-diamine, N,N',N",N'"-tetra[4-t-butylphenyl]-[p-terphenyl]-4,4"-diamine, N,N'-bis-(3,4-dimethylphenyl)-4-biphenyl amine, N,N'-diphenyl-N,N'-bis (4-methylphenyl)-1,1'-biphenyl-4,4'diamine, N,N',bis-(4-methylphenyl)-N,N'-bis(4-ethylphenyl)-1,1'-3,3'-dimethylbiphenyl)-4,4'diamine, 4-4'-bis(diethylamino)-2,2'-dimethyltriphenyl methane, N,N'-diphenyl-N,N'-bis(3-methylphenyl)-[1,1'-biphenyl]-4,4'diamine, N,N'-diphenyl-N,N'-bis(alkyl phenyl)-1,1'-biphenyl-4,4-diamine, and N,N'-diphenyl-N,N'-bis(chlorophenyl)-1,1'-biphenyl-4,4'-diamine, and the like. Since the last two aromatic diamines are commonly used hole transporting molecules for typical electrophotographic imaging member fabrication, they are selected for presenting disclosure embodiment preparation and are thereby represented by the molecular structure A below:

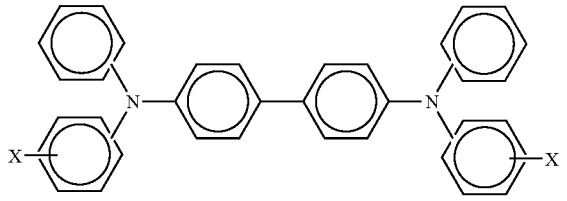

wherein X is selected from the group consisting of alkyl, hydroxy, and halogen.

In embodiments, the charge transport layer comprises N,N'-diphenyl-N,N'-bis(3-methylphenyl)-[1,1'-biphenyl]-4,4'diamine (mTBD) and a polymer. In embodiments, the small molecule is present in the charge transport layer in an amount of from about 30 to about 70 percent, or from about 40 to about 60, or from about 45 to about 55, or about 51.7 percent by weight of total solids.

A polymer is included in the charge transport layer. The polymer is present in an amount of from about 30 to about 70, or from about 40 to about 60, or from about 45 to about 55, percent by weight of total solids.

Examples of suitable polymers include polystyrene and polycarbonates. An example of a suitable polymer is polystyrene having a Tg of about 100° C. An example of a commercially available polystyrene is a thermoplastic film forming polymer and one having a molecular weight of about 45,000, and is available from Scientific Polymer Products. With the addition of a charge transport molecule, such as mTBD, however, the polystyrene forms a solid solution charge transport layer having an effective photoelectrical function, and having a relatively low Tg. The resulting charge transport layer after the addition of the charge transport material, such as mTBD, has a Tg of from about 10 to about 45° C., or from about 20 to about 40° C., or from about 25 to about 35° C. In embodiments, the polystyrene has a relatively low molecular weight of from about 20,000 to about 150,000, or from about 40,000 to about 100,000.

In embodiments, the elastomeric charge transport layer is alternatively formulated using a thermoplastic film forming polycarbonate selected from the group consisting of a poly (4,4'-isopropylidene diphenyl carbonate), a poly(4,4'-diphenyl-1,1'-cyclohexane carbonate), or a polyphthalate carbonate resin. Poly(4,4'-isopropylidene diphenyl carbonate) is a thermoplastic polymer of Bisphenol A, having a molecular weight of from about 35,000 to about 40,000, and is available as Lexan® 145 from General Electric Company. Another suitable polymer is a polycarbonate having a molecular weight of from about 40,000 to about 45,000, available as Lexan® 141 also from the General Electric Company. A further suitable polycarbonate is one having a molecular weight of from about 50,000 to about 120,000, and available as MAKROLON® from Farbenfabricken Bayer A. G. Still yet another polycarbonate is one having a molecular weight of from about 20,000 to about 50,000, available from Mobay Chemical Company as MERLON®. All these thermoplastics polymers of Bisphenol A poly(4,4'-isopropylidene diphenyl carbonate) are having a common molecular formula described below, wherein n is a number of from about 80 to about 500:

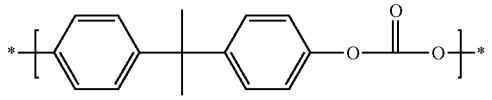

Another type of thermoplastic polycarbonate of interest is poly(4,4-diphenyl-1,1'-cyclohexane carbonate), which is a also film forming thermoplastic polymer structurally modified from Bisphenol A polycarbonate; it is commercially available as LUPILON® from Mitsubishi Chemicals and having a molecular formula as follows, wherein n is a number of from about 70 to about 450:

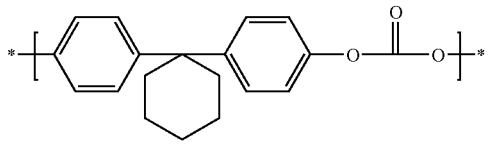

The above two types of polycarbonates have a Tg of from about 145° C. to about 165° C.

In an embodiment, a polyphthalate carbonate resin can be used. This is a thermoplastic copolymer which is obtained from General Electric Company as LEXAN® PPC 4701. It has a glass transition temperature (Tg) of about 170° C. and with a molecular formula of:

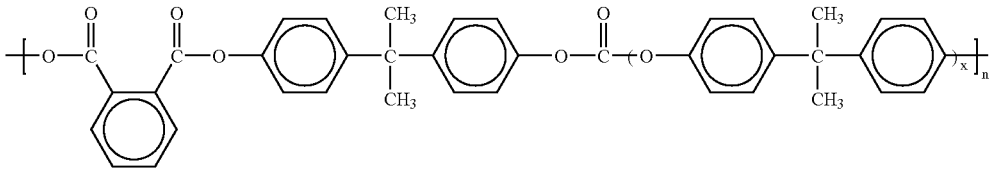

where x is an integer from about 1 to about 10, and n is the degree of copolymerization, and is a number of from about 50 to about 300.

Since all these polycarbonates have a Tg exceeding 100° C., it is necessary to modify them so that each of them can be formulated into an elastomeric charge transport layer after addition of m-TBD to its polymer matrix. To achieve the desired outcome, a Tg suppressing component can be incorporated to the charge transport layer to effect lowering of the Tg of the resulting charge transport layer formulation.

In essence, a determined amount of a high boiler oligomer carbonate liquid is added to the charge transport layer coating solution, so that the prepared charge transport layer can have a low Tg in order to function as an elastomeric layer. The Tg suppressing component can be added to the polymer and charge transport compound in an amount of from about 20 to about 50, or from about 30 to about 40.

The selection of the oligomer carbonate liquid as the desired Tg suppression agent is based on the fact that it is: (a) substantially chemically similar to the thermoplastic polycarbonate binder, (b) highly compatible with the diamine charge transport compound, and (c) a high boiler of exceeding 200° C. It is desired that the oligomer carbonate liquids are able to satisfy these three criteria in order to ensure that the presence in the charge transport layer is permanent and does not cause material phase separation to deleteriously impact the photo-electrical performance of the fabricated imaging member. Examples of oligomeric carbonate liquids that meet these requirements are given and described hereinafter.

In embodiments, the formulated elastomeric charge transport layer may comprise an oligomer aromatic carbonate of the following molecular structure of Formula I:

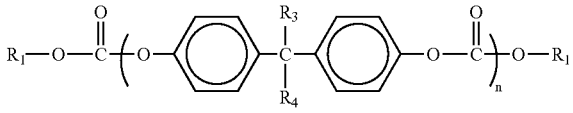

wherein $R_1$ is either an alkyl group or an unsaturated hydrocarbon alkenyl group at each molecular terminal having from about 2 to about 5 carbon atoms, $R_3$ and $R_4$ are the same or different alkyl groups having about 1 to about 3 carbon atoms, and n is an integer from about 1 to about 6.

In a specific embodiment, the $R_1$ in the oligomer carbonate of Formula I is an allyl group and $R_3$ and $R_4$ are the same, being a methyl group, then the liquid used for creating the elastomeric charge transport layer is an oligomer Bisphenol A carbonate shown in Formula II below. However, if n is 1, Formula II becomes a Bisphenol A carbonate monomer called bis allyl carbonate of Bisphenol A, wherein n is a number in the below Formula II is from about 1 to about 6.

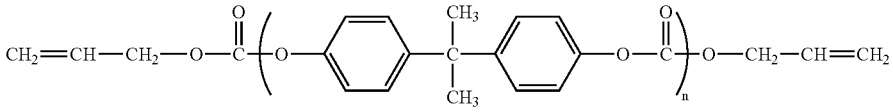

Alternative liquid oligomers of aromatic carbonate derived from Bisphenol A and suitable for use in embodiments to create the elastomeric charge transport layer herein also include those set forth below in Formulas (III)-(V) wherein n is an integer from about 1 to about 6:

Formula (III)

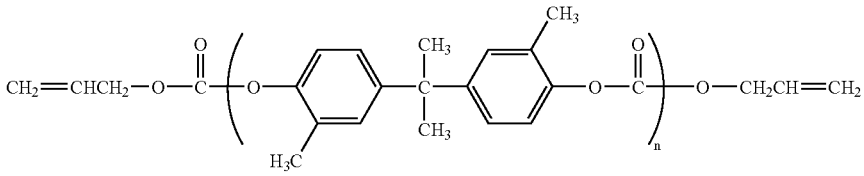

Formula (IV)

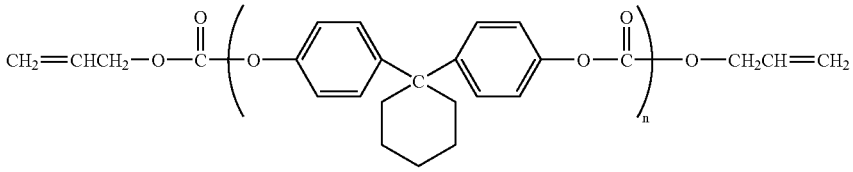

Formula (V)

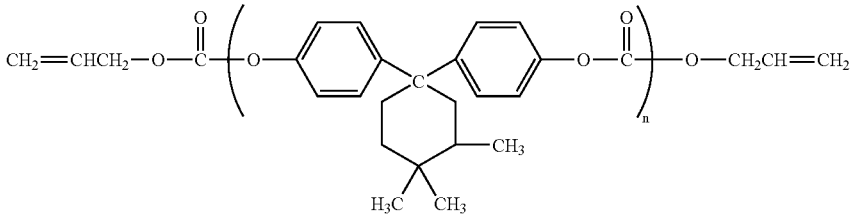

All these high boiling carbonate liquids of Formulas (I)-(V) disclosed above may be incorporated into any conventional thermoplastic charge transport layer formed with organic solutions to effect Tg suppression result of the layer. They are highly compatible with both the polymer binder and the small molecules charge transport compound. Also, each has a boiling point that is in excess of 200° C., or from about 200 to about 400° C., or from about 250° C. to about 330° C., or from about 260 to about 300° C.

Generally, the thickness of the charge transport layer is between about 10 and about 50 micrometers, but thicknesses outside this range can also be used. The elastomeric charge transport layer formulated should be an insulator to the extent that the electrostatic charge placed on the charge transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Any suitable and conventional technique may be used to mix and thereafter apply the charge transport layer coating mixture to the charge-generating layer. Typical application techniques include spraying, dip coating, roll coating, wire wound rod coating, and the like. Drying of the deposited coating may be effected by any suitable conventional technique such as oven drying, infrared radiation drying, air drying and the like.

The above formulation provides an elastomeric charge transport layer. This elastomeric property allows the charge transport layer to be highly flexible and to bend readily, hence the charge transport layer is less susceptible to cracking. However, because the layer is elastomeric, the layer may be too soft to provide wear resistance, poor toner image transfer efficiency to paper, and impact residual toner/dirt debris removal from which surface with a conventional cleaning blade.

To solve the above problems, a robust overcoat layer 7 may be applied to the elastomeric charge transport layer. The overcoat protects the photoreceptor surface against abrasion as well as corona effluents and airborne VOC contaminants attack. In embodiments, the overcoat layer comprises a polymer such as a polymer selected from the group consisting of polycarbonate, polystyrene, polyether sulfone, polysulfone, polyamide, polyvinyl chloride, crosslinked melamine-formaldehyde, crosslinked polycarbonate, and the like.

In embodiments, the overcoat layer is a relatively hard crack-resistant overcoat layer and has a thickness of from about 1 to about 10 microns, or from about 2 to about 8 microns, or from about 3 to about 6 microns, or from about 4 to about 5 microns. In embodiments, the polymer is present in the overcoat layer in an amount of from about 90 to about 99 percent, or from about 95 to about 97 percent by weight of total solids.

In embodiments, the outer protective overcoat layer comprises polycarbonate. A commercially available example of a polycarbonate useful herein includes MAKROLON®, such as MAKROLON® 5705, 5900, LUPILON® Z-800, and the like. In embodiments, the polymer is a relatively high molecular weight polymer having molecular weight of from about 100,000 to about 250,000.

In embodiments, the charge transport molecule is present in the overcoat in amounts of from about 1 to about 10 percent, or from about 3 to about 5 percent by weight, based on the weight of the resulting overcoat. In embodiments, the small molecule or second charge transport component, can be the same or different as that used in the charge transport layer such as triphenylmethane, bis(4-diethylamine-2-methylphenyl) phenylmethane, stylbene, hydrozone, an aromatic amine comprising tritolylamine, arylamine, enamine phenanthrene diamine, N,N'-bis (4-methylphenyl)-N,N'-bis [4-(1-butyl)-phenyl]-[p-terphenyl]-4,4"-diamine, N,N'-bis (3-methylphenyl)-N,N'-bis[4-(1-butyl)-phenyl]-[p-terphenyl-4,4"-diamine, N,N'-bis (4-t-butylphenyl)-N,N'-bis [4-(1-butyl)-phenyl]-[p-terphenyl]-4,4"-diamine, N,N',N",N'"-tetra[4-(1-butyl)-phenyl]-p-terphenyl]-4,4"-diamine, N,N',N",N'"-tetra[4-t-butyl-phenyl]-[p-terphenyl]-4,4"-diamine, N,N'-bis-(3,4-dimethylphenyl)-4-biphenyl amine, N,N'-diphenyl-N,N"-bis(4-methylphenyl)-1,1'-biphenyl-4,4'diamine, N,N',bis-(4-methylphenyl)-N,N'-bis(4-ethylphenyl)-1,1'-3,3'-dimethylbiphenyl)-4,4'diamine, 4-4'-bis(diethylamino)-2,2'-dimethyltriphenyl methane, N,N'-diphenyl-N,N'-bis(3-methylphenyl)-[1,1'-biphenyl]-4,4'diamine, N,N'-diphenyl-N,N'-bis(alkyl phenyl)-1,1'-biphenyl-4,4-diamine, and N,N'-diphenyl-N,N'-bis (chlorophenyl)-1,1'-biphenyl-4,4'-diamine, and the like. In specific embodiments, the small molecule is N,N'-diphenyl-N,N'-bis(3-methylphenyl)-[1,1'-biphenyl]-4,4'diamine (mTBD).

Alternatively, the protective overcoat may be created from a hole-transporting polymer, which has inherent hole transporting capability without incorporation of small molecule charge transporting compounds in its matrix.

In a further embodiment, the protective overcoat disclosed in all the above embodiments may include nanosilica, PTFE, and metal oxides to impart wear resistance. It may also be incorporated with an anti-oxidant and an antiozonant to provide overcoat material degradation protection.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Comparative Example 1

Preparation of Polycarbonate and Small Molecule Charge Transport Laver (Tg of 85° C.) on Photoreceptor An electrophotographic imaging member was prepared by providing a 0.02 micrometer thick titanium layer coated on a substrate of a biaxially oriented polyethylene naphthalate substrate (KADALEX®, available from Dupont Teijin Films) having a thickness of 3.5 mils (89 micrometers). The titanized KADALEX® substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and effect the formation of a crosslinked silane blocking layer. The resulting blocking layer was of an average dry thickness of 0.04 micrometer as measured with an ellipsometer.

An adhesive interface layer was then applied by extrusion coating to the blocking layer with a coating solution containing 0.16 percent by weight of ARDEL® polyarylate, having a weight average molecular weight of about 54,000, available from Toyota Hsushu, Inc., based on the total weight of the solution in an 8:1:1 weight ratio of tetrahydrofuran/monochloro-benzene/methylene chloride solvent mixture. The adhesive interface layer was allowed to dry for 1 minute at 125° C. in a forced air oven. The resulting adhesive interface layer had a dry thickness of about 0.02 micrometer.

The adhesive interface layer was thereafter coated over with a charge-generating layer. The charge-generating layer dispersion was prepared by adding 0.45 gram of IUPILON 200®, a polycarbonate of poly(4,4'-diphenyl)-1,1'-cyclohexane carbonate (PC-z 200) available from Mitsubishi Gas Chemical Corporation, and 50 milliliters of tetrahydrofuran into a 4 ounce glass bottle. An amount of 2.4 grams of hydroxygallium phthalocyanine Type V, and 300 grams of ⅛ inch (3.2 millimeters) diameter stainless steel shot were added to the solution. This mixture was then placed on a ball mill for about 20 to about 24 hours. Subsequently, 2.25 grams of poly(4,4'-diphenyl-1,1'-cyclohexane carbonate) having a weight average molecular weight of 20,000 (PC-z 200) were dissolved in 46.1 grams of tetrahydrofuran, then added to the hydroxygallium phthalocyanine slurry. This slurry was then placed on a shaker for 10 minutes. The resulting slurry was thereafter coated onto the adhesive interface by extrusion application process to form a layer having a wet thickness of 0.25 mil. However, a strip of about 10 millimeters wide along one edge of the substrate web stock bearing the blocking layer and the adhesive layer was deliberately left uncoated by the charge-generating layer to facilitate adequate electrical contact by a ground strip layer to be applied later. This charge-generating layer comprised of poly(4,4'-diphenyl)-1,1'-cyclohexane carbonate, tetrahydrofuran and hydroxygallium phthalocyanine, was dried at 125° C. for 2 minutes in a forced air oven to form a dry charge generating layer having a thickness of 0.4 micrometer.

The coated charge-generating layer was simultaneously coated over with a charge transport layer. The charge transport layer was prepared by introducing into an amber glass bottle in a weight ratio of 1:1 (or 50 weight percent of each) of MAKROLON 5705®, a Bisphenol A polycarbonate thermoplastic having a molecular weight of about 120,000 and a glass transition temperature (Tg) of 156° C. commercially available from Farbensabricken Bayer A. G. and N,N'-diphenyl-N,N'-bis(3-methylphenyl)-1,1'-biphenyl-4,4'-diamine (m-TBD) charge transporting compound represented by

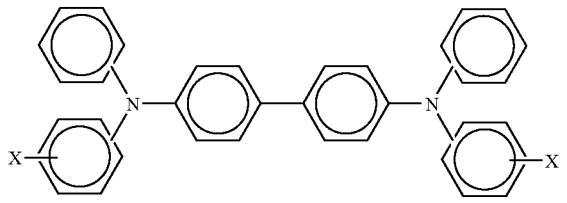

wherein X is a methyl group that is attached at the meta position.

The resulting mixture was dissolved to give 15 percent by weight solid in methylene chloride. This solution was applied on the charge-generating layer to form a coating, which upon drying in a forced air oven at 125° C. for 3 minutes, gave a 29 micrometers dry thickness charge transport layer. The glass transition temperature (Tg) of the charge transport layer was about 85° C.

The prepared imaging member containing all of the above layers and having the material structure the same as that illustrated in FIG. 2 but without an overcoat layer 7, was then used to serve as a comparative control sample.

Example 1

Preparation of Polycarbonate, Tg Suppressing Compound and Small Molecule Charge Transport Layer (Tg of 31° C.) on Photoreceptor.

An electrophotographic imaging member was fabricated using the same materials and the same process as those described in the Comparative Example, but with the exception that the charge transport layer coating solution was prepared to include 30 weight percent of a high boiler Bisphenol A carbonate monomer liquid (boiling point of about 300° C.), in three different amounts, given by Formula (II) below:

Formula (IV)

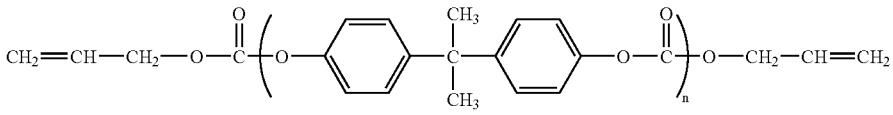

Since this liquid compound is a Bisphenol A bisallyl carbonate monomer (commercially available for PPG, Inc.) to that of polycarbonate MAKROLON® 5705 binder, its presence in any amount should have good compatibility with the material compositions of the formulated charge transport layer.

The prepared charge transport layer coating solution was then applied onto the charge-generating layer and followed by subsequent drying at elevated temperature. This, in turn, produced an imaging member having a charge transport layer containing 30 weight percent liquid Bisphenol A carbonate monomer incorporation in the 29 micrometers dried charge transport layer. The Tg was about 31° C. The imaging member was then provided with a 5 micrometer thick MAKROLON® 5900 protective overcoating layer 7 (as that shown in FIG. 2) containing 3 weight percent of same charge transport molecules as that in the charge transport layer. Since MAKROLON® 5900, commercially available from Farbensabricken Bayer A. G., had a very high molecular weight of about 190,000, it formed a mechanical robust protective overcoat.

Example 2

Preparation of Polystyrene and Small Molecule Charge Transport Layer (Tg of 39° C.) on Photoreceptor An electrophotographic imaging member was fabricated using the same materials, the same process, and a MAKROLON® 5900 overcoat layer as those described in Example 1, with the exception that the charge transport layer was prepared to using polystyrene and N,N'-diphenyl-N,N'-bis(3-methylphenyl)-1,1'-biphenyl-4,4'-diamine charge transporting compound in a weight ratio of 48.4 percent by weight: 51.7 percent by weight. Although the polystyrene (having a molecular weight of about 45,000 and available from Scientific Polymer Products) was a thermoplastic, which, by itself, had a Tg of about 100° C., nonetheless the prepared charge transport layer gave a Tg of about 39° C., which was protected by the applied MAKROLON® 5900 overcoat.

Example 3

Imaging Member Corona Exposure Testing

The imaging members of all the above examples were evaluated for corona effluents exposure charge transport layer cracking tests.

All the imaging members prepared, as described in the preceding examples, were allowed to sit in the shelf for 5 weeks and then each cut to provide five 2"×3" sample pieces, followed by individually rolling each cut piece, with the charge transport layer facing outwardly, into a 19 millimeter diameter sample tube. These imaging member sample tubes were then subsequently subjected to corona effluents exposure tests for corona effect assessment. Corona effluents were generated by turning on a charging device in an enclosed large glass tubing operated under 700 microamperes and 8 KV conditions. The corona effluent exposure test was carried out by placing these imaging member sample tubes inside the enclosed glass tube, simultaneously exposing the test samples to the gaseous effluents for 6 hours time duration, and under a temperature controlled at 46° C. Examination of each of these samples, after exposure test and observed under 70× magnification with an optical microscope, had found that corona species interaction with the imaging member charge transport layer (while the sample was under the static bending strain condition) for both imaging members of Examples 1 and 2 did not have development of charge transport layer cracking, while the Comparative Control imaging member counterpart developed extensive corona exposure bending strain induced charge transport layer cracking.

While the invention has been described in detail with reference to specific and embodiments, it will be appreciated that various modifications and variations will be apparent to the artisan. All such modifications and embodiments as may readily occur to one skilled in the art are intended to be within the scope of the appended claims.

What is claimed is:

1. An imaging member comprising:

a substrate;

a charge transport layer comprising a first polymer selected from the group consisting of polystyrene and polycarbonate, and a first charge transport material dispersed therein, wherein said first charge transport material is N,N'-diphenyl-N,N'-bis(3-methylphenyl)-[1,1'-biphenyl]-4,4'diamine, and wherein the charge transport layer has a glass transition temperature of from about 10 to about 45° C.; and an overcoat layer positioned on said charge transport layer, wherein the overcoat layer comprises a second polymer and a second charge transport material comprising N,N'-diphenyl-N,N'-bis(3-methylphenyl)-[1,1'-biphenyl]-4,4'diamine dispersed therein.

2. An imaging member in accordance with claim 1, wherein said glass transition temperature of said charge transport layer is from about 20 to about 40° C.

3. An imaging member in accordance with claim 1, wherein said glass transition temperature of said charge transport layer is from about 25 to about 35° C.

4. An imaging member in accordance with claim 1, wherein said first polymer is present in the charge transport layer in an amount of from about 30 to about 70 percent by weight of total solids.

5. An imaging member in accordance with claim 1, wherein said charge transport layer further comprises a glass transition suppressing compound.

6. An imaging member in accordance with claim 5, wherein said glass transition suppressing compound is an oligomer carbonate.

7. An imaging member in accordance with claim 6, wherein said oligomer carbonate is selected from the group consisting of oligomer aromatic carbonate and oligomer bisphenol A carbonate.

8. An imaging member in accordance with claim 1, wherein said first charge transport material is present in the charge transport layer in an amount of from about 30 to about 70 percent by weight of total solids.

9. An imaging member in accordance with claim 1, wherein said second polymer is selected from the group consisting of polycarbonate and polystyrene.

10. An imaging member in accordance with claim 1, wherein said second polymer is present in the overcoat layer in an amount of from about 90 to about 99 percent by weight of total solids.

11. An imaging member in accordance with claim 1, wherein said second charge transport material is present in the overcoat layer in an amount of from about 1 to about 10 percent.

12. An imaging member in accordance with claim 1, wherein said overcoat layer has a thickness of from about 1 to about 10 microns.

13. An imaging member comprising:

a substrate;

a charge transport layer comprising polystyrene and N,N'-diphenyl-N,N'-bis(3-methylphenyl)-[1,1'-biphenyl]-4,4'diamine dispersed therein, and wherein the charge transport layer has a glass transition temperature of from about 10 to about 45° C.; and an overcoat layer positioned on said charge transport layer, wherein said overcoat layer comprises a polymer selected from the group consisting of polycarbonate and polystyrene, and comprises N,N'-diphenyl-N,N'-bis(3-methylphenyl)-[1,1'-biphenyl]-4,4'diamine, and further wherein said overcoat layer has a thickness of from about 1 to about 10 microns.

14. An imaging member comprising:

a substrate;

a charge transport layer comprising polycarbonate, N,N'-diphenyl-N,N'-bis(3-methylphenyl)-[1,1'-biphenyl]-4,4'diamine, and a glass transition suppressing compound, and wherein the charge transport layer has a glass transition temperature of from about 10 to about 45° C.; and an overcoat layer positioned on said charge transport layer, wherein said overcoat layer comprises a polymer selected from the group consisting of polystyrene and polycarbonate, and comprises N,N'-diphenyl-N,N'-bis(3-methylphenyl)-[1,1'-biphenyl]-4,4'diamine, and further wherein said overcoat layer has a thickness of from about 1 to about 10 microns.

15. An image forming apparatus for forming images on a recording medium comprising:

a) a photoreceptor member having a charge retentive surface to receive an electrostatic latent image thereon, wherein said photoreceptor member comprises a substrate, a charge transport layer comprising a first polymer and a first charge transport material dispersed therein, and wherein the charge transport layer has a glass transition temperature of from about 10 to about 45° C.; and an overcoat layer positioned on said charge transport layer, wherein said overcoat layer comprises a second polymer and a second charge transport material dispersed therein;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

16. An imaging member comprising:

a substrate;

a charge transport layer comprising a first polymer selected from the group consisting of polystyrene and polycarbonate, and a first charge transport material dispersed therein, wherein said first charge transport material is N,N'-diphenyl-N,N'-bis(3-methylphenyl)-[1,1'-biphenyl]-4,4'diamine, and wherein the charge transport layer has a glass transition temperature of from about 25 to about 35° C.; and an overcoat layer positioned on said charge transport layer, wherein the overcoat layer comprises a second polymer and a second charge transport material dispersed therein.

* * * * *